US005337522A

United States Patent [19]

Chien

[11] Patent Number: 5,337,522

[45] Date of Patent: Aug. 16, 1994

[54] GRINDSTONE SHIELD AND WORKTABLE OF GRINDING MACHINE

[76] Inventor: Mu-Yen Chien, 45 Szu-Wei Street, Taichung, Taiwan

[21] Appl. No.: 977,619

[22] Filed: Nov. 17, 1992

[51] Int. Cl.[5] ..... B24B 41/06

[52] U.S. Cl. ..... 51/240 A; 51/273; 51/128

[58] Field of Search ..... 51/268, 273, 239, 240 A, 51/216 A, 217 A, 216 ND, 128; 83/764, 767

[56] References Cited

U.S. PATENT DOCUMENTS

| | | | |
|---|---|---|---|
| 952,270 | 3/1910 | Milks | 83/767 |
| 1,032,046 | 7/1912 | Craig | 83/767 |
| 1,244,584 | 10/1917 | Carter | 51/273 |
| 1,332,713 | 3/1920 | D'Arcy | 83/767 |
| 2,069,395 | 2/1937 | Tautz | 51/273 |
| 2,374,716 | 5/1945 | Wiken | 51/239 |
| 4,228,618 | 10/1980 | Jensen | 51/273 |
| 4,259,814 | 4/1981 | Glaser et al. | 51/240 A |
| 4,574,530 | 3/1986 | Handler et al. | 51/240 A |
| 4,794,740 | 1/1989 | Keith et al. | 51/273 |

*Primary Examiner*—Jack Lavinder

[57] ABSTRACT

A grinding machine has two grindstones, each of which has a grindstone shield disposed thereover. The grindstone shield is provided with a dust receiving portion in communication with a vacuum cleaner via a connecting tube. Pivoted to the grindstone shield is a worktable having an angle adjusting plate with a bevel scale disposed along the outer edge thereof. A plurality of concave retaining surfaces are constructed along the outer edge of the angle adjusting plate in such a manner that the concave retaining surfaces are corresponding in locations to a plurality of predetermined angles. The grindstone shield is further provided with a locating element engageable with the concave retaining surfaces of the worktable for facilitating the angle adjustment of the worktable. The dust produced in the grinding process is removed from the machine by the vacuum cleaner so as to prevent the dust from polluting the air at the work site.

1 Claim, 3 Drawing Sheets

GRINDSTONE SHIELD AND WORKTABLE OF GRINDING MACHINE

BACKGROUND OF THE INVENTION

The present invention relates to a grinding machine, and more particularly to a grindstone shield and a worktable of the grinding machine. The grindstone shield is provided with a receiving portion for collecting the dust produced in the grinding process, and with a connecting tube that can be fastened to a vacuum cleaner, and further with an angle adjusting plate pivoted to the grindstone shield for supporting a work piece and for adjusting the inclination of the worktable of the grinding machine. The angle adjusting plate is provided with a plurality of concave retaining surfaces which are situated respectively at the predetermined angles and are intended for retaining therein the locating element disposed on the grindstone shield, so as to facilitate the job of adjusting the inclination of the worktable and locating the work piece on the worktable.

The prior art grinding machine is generally provided horizontally at the center thereof with a motor having two end portions, each of which is coupled with a grindstone so that the motor drives the grindstones synchronously. In addition, each grindstone has a shield disposed thereover. A worktable for supporting the work piece is mounted in front of the shield. Such prior art grinding machine is in itself defective in that the dust produced in the grinding process is a potential health hazard to a grinder, in view of the fact that the centrifugal force of the rotating grindstone and the turbulent air flow generated by the rotating grindstone make it difficult to contain the dust so produced.

The worktable of the prior art grinding machine is provided with an angle measuring plate having a size corresponding to one quarter of a disk. Such angle measuring plate is fastened to the outer side of the shield of the grindstone by means of a bolt and is provided with a shaft pivoted to the shield. As a result, a grinder is able to adjust the bevel between the worktable and the grindstone by using the shaft as a central of axis and by using the distance between the shaft and the bolt as a radius. Thereafter, the worktable is locked in that position by tightening the bolt. The desired angle so adjusted between the worktable and the grindstone is indicated on the bevel scale of the angle measuring plate by a pointer that is fastened to the bolt.

The prior art method of adjusting the bevel between the worktable and the grindstone is rather cumbersome and inefficient. For example, the most commonly used grinding angles are zero degree, 15 degrees, 30 degrees, 45 degrees, etc., which must be individually adjusted and checked each time when the use of such bevel is called for.

SUMMARY OF THE INVENTION

The object of the present invention is to provide a grinding wheel machine with a grindstone shield having a dust collecting portion and a connecting tube that can be fastened to a vacuum cleaner, which is used for sucking the collected dust out, so as to prevent the air at the work site from being polluted by the dust that is potentially hazardous to the health of the worker.

It is another objective of the present invention to provide a grinding wheel machine with a worktable having an angle adjusting plate provided with a plurality of concave retaining surfaces located respectively at predetermined angles along the arcuate edge of the angle adjusting plate. Such concave retaining surfaces are intended for use, in conjunction with the locating element of the grindstone shield, in improving the efficiency of adjusting and checking quickly the bevel formed by the worktable and the grindstone shield.

DETAILED DESCRIPTION OF THE PREFERRED EMBODIMENT

Figure 1:
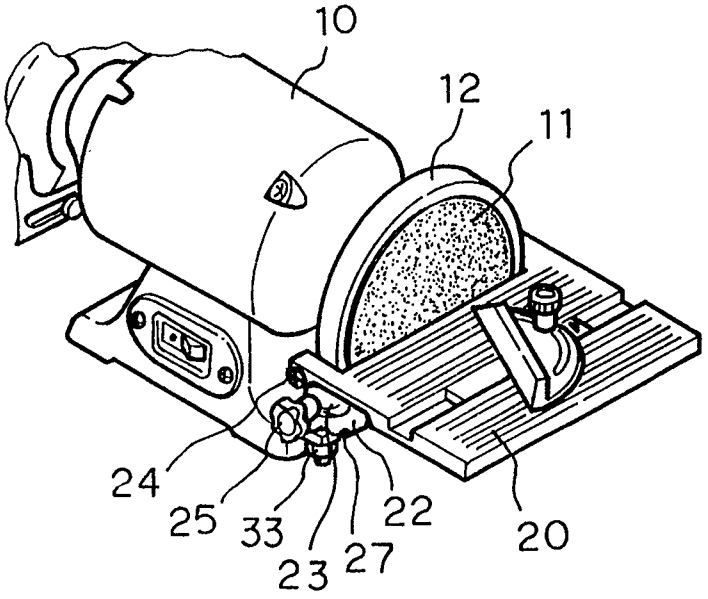
FIG. 1 shows a perspective view of a grinding machine of the present invention.
Figure 2:
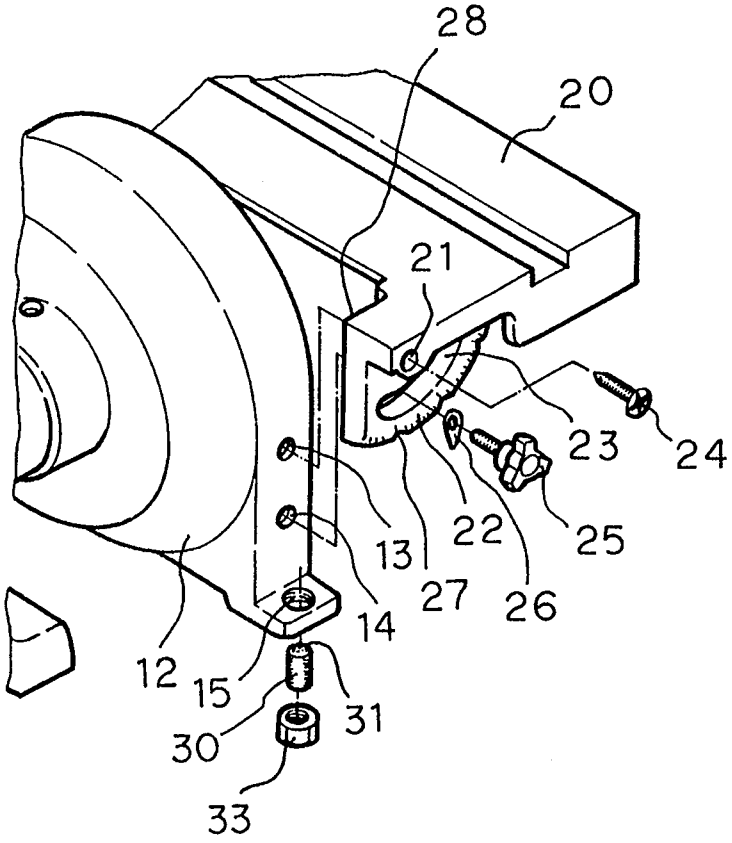
FIG. 2 shows an exploded view of a portion of the grinding machine as shown in FIG. 1.
Figure 3:
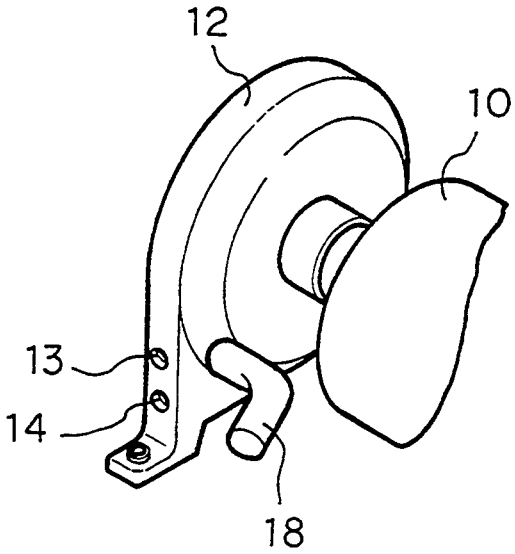
FIG. 3 shows a rear elevational view of a portion of the grinding machine as shown in FIG. 1.
Figure 4:
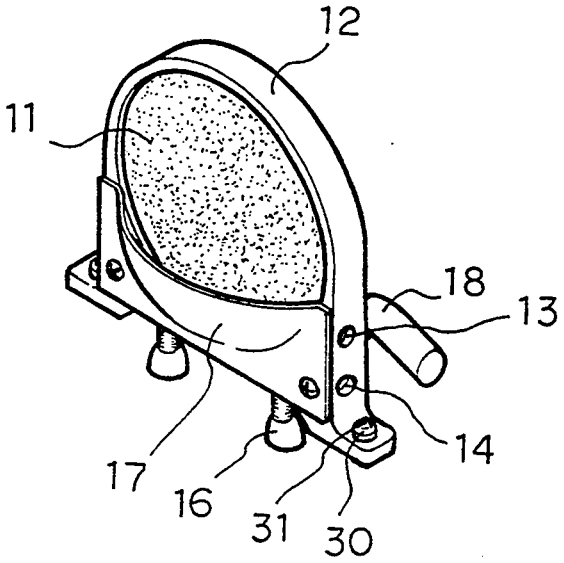
FIG. 4 shows a perspective view of a grindstone of the grinding machine of the present invention.
Figure 5:
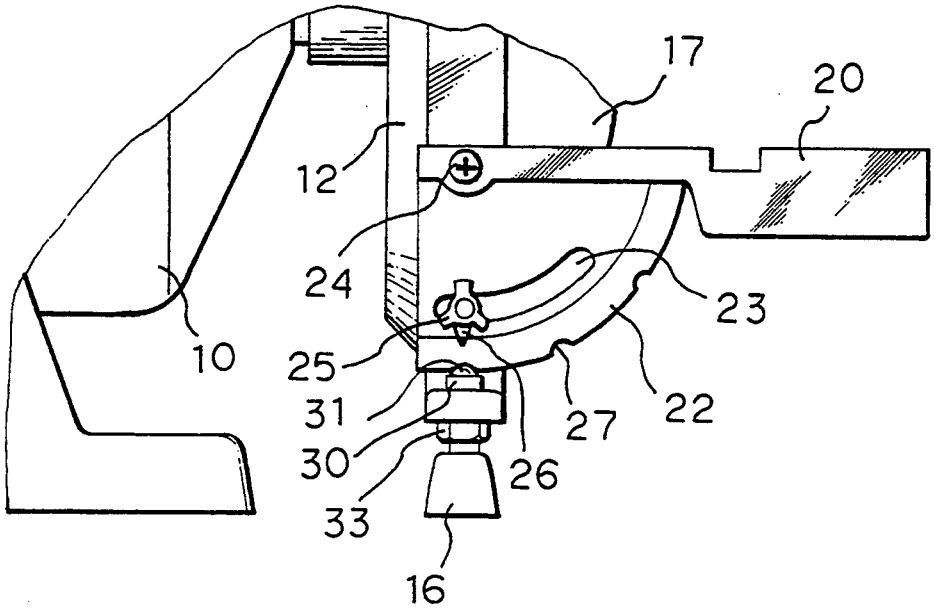
FIG. 5 shows a side elevational view of a portion of the grinding machine as shown in FIG. 1.

As shown in FIGS. 1–6, the present invention comprises: a motor 10, two grindstones 11, two grindstone shields 12, a worktable 20.

The motor 10 is used to drive synchronously two grindstone 11 fastened respectively to both ends of the motor 10.

The grindstone shield 12 is disposed over the grindstone 11 and is fastened to a housing of the motor 10. The grindstone shield 12 is provided at the lower end portion thereof with an upper threaded hole 13 and a lower threaded hole 14. Located at the extreme end of the grindstone shield 12 is a vertical threaded hole 15. A grinding dust receiving portion 17 is disposed outside the lower portion of the grindstone 11. The dust receiving portion 17 is in communication with a connecting tube 18 which is disposed at a location opposite to the location of the dust receiving portion 17 and is connected with a vacuum cleaner (not shown in the drawings). The grindstone shield 12 is further provided with a plurality of support legs 16 attached to the underside of the bottom thereof for stabilizing the motor 10 as veil as the grindstone shield 12.

Figure 6:
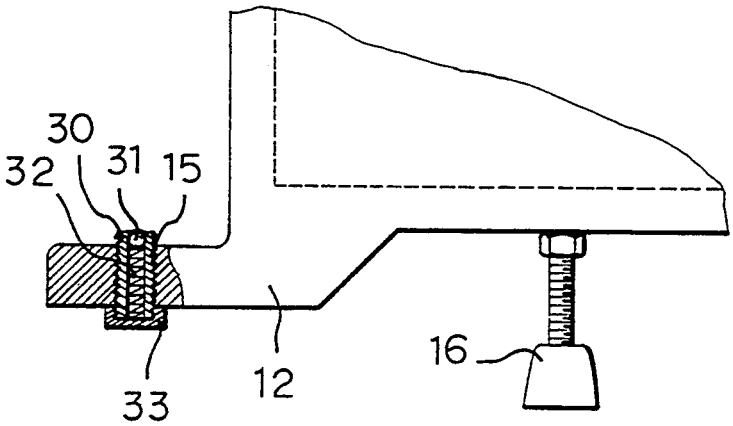
FIG. 6 shows a schematic view of a locating element of a grindstone shield of the grinding machine of the present invention.

The hollow locating element 30 is received in the vertical threaded hole 15 of the grindstone shield 12 and is provided therein with a locating ball 31 and a spring 32 located under the locating ball 31, as shown in FIG. 6. A nut 33 is used to screw onto the bottom end of the locating element 30. As a result, the spring 32 always remains in a state of urging the locating ball 31, so as to force the locating ball 31 to emerge partially beyond the top end of the locating element 30, which has a diameter slightly smaller than that of the locating ball 31.

The worktable 20 has a bridging portion 28 provided with a through hole 21 corresponding in location to the upper threaded hole 13 of the grindstone shield 12. A fastening bolt 24 is screwed into the through hole 21 of the worktable 20 and the upper threaded hole 13 of the grindstone shield 12, so as to permit the worktable 20 to turn. As a result, the bevel formed by the worktable 20 and the grindstone 11 can be adjusted as desired by turning the worktable 20 to a desired position. Located under the bridging portion 28 of worktable 20 is an angle adjusting plate 22 having a profile corresponding to a quarter of a disk and having an arcuate hole or slot 23 and further having a bevel scale located along the arcuate edge thereof. A locking bolt 25 is put through the hole of a pointer 26 and the arcuate hole 23 of the angle measuring plate 22 and is then screwed into the lower threaded hole 14 of the grindstone shield 12. In conjunction with a movement of the worktable 20, the pointer 26 moves along the arcuate hole 23 to point out the bevel formed by the worktable 20 and the grindstone 11. The angle adjusting plate 22 is further provided with a plurality of concave retaining surfaces 27 located along the arcuate edge thereof where the bevel scale is located. The concave retaining surface 27 are located respectively at the predetermined angles that are frequently used. A desired bevel can be locked in by allowing the locating ball 31 of the locating element 30 to go into the concave retaining surface 27 with a snapping sound which serves to remind the grinder that the grinding process can be started.

Before proceeding with the grinding process with the grinding machine of the present invention, the connecting tube 18 of the grindstone shield 12 must be fastened with the suction tube of the vacuum cleaner. (not shown in the drawings), which should be started prior to the start-up of the motor 10. As soon as the grinding process is under way, the dust so produced is collected in the dust receiving portion 17 and is subsequently removed therefrom by the vacuum cleaner, without polluting the air at the work site.

In order to adjust the worktable 20 to a desired position, the locking bolt 25 must be first loosened, so as to permit the worktable 20 turn on the fastening bolt 24 working as a rotating shaft. The worktable 20 is turned to form with the grindstone 11 a desired bevel which may be a commonly used bevel provided with the concave retaining surfaces 27 on the angle adjusting plate 22. Thereafter, the locating ball 31 of the locating element 30 is allowed to go into the concave retaining surfaces 27 with a snapping sound. The worktable 20 can be then locked in that desired position by tightening the locking bolt 25.

The set-up of the locating elements 30 and the concave retaining surfaces 27, as described above, may be reversed to bring about an equally satisfactory outcome. In other words, the concave retaining surfaces 27 are arranged at the lower end portion of the periphery of the grindstone shield 12 while the locating elements 30, each of which contains a locating ball 31, are disposed in the angle adjusting plate 22 in such a manner that the locating elements 30 are corresponding in location to the predetermined angles that are commonly used in the grinding process.

The present invention is superior to the grinding process with the following advantages:

(1) The dust produced in the grinding process is completely removed from the work site so as to ensure that the quality of air at the work site is such that a worker's health is not jeopardized.

(2) The work efficiency of the grinding machine of the present invention is greatly enhanced, in view of the fact that the worktable of the grinding machine of the present invention can be rapidly adjusted to and subsequently located at a specific angle that is commonly used.

I claim:

1. A grinding machine comprising:

(a) a motor capable of driving synchronously two grindstones fastened thereto;

(b) a grindstone shield disposed over each of said two grindstones and fastened to a housing of said motor and further provided with an upper threaded hole and a lower threaded hole which are located at each of two opposite lower ends of said grindstone shield; and (c) a worktable having a bridging portion provided with a through hole corresponding in location to said upper threaded hole of said grindstone shield, said worktable further having an angle adjusting plate which has a profile corresponding to a quarter of a disk and is located under said bridging portion, with said angle adjusting plate having an arcuate slot and a bevel scale disposed on an outer edge thereof, said arcuate slot corresponding in location to said lower threaded hole of said grindstone shield;

wherein said grinding machine is characterized in that said grindstone shield is provided at the lower end thereof with a vertical threaded hole and with a dust receiving portion located outside the lower end of said grindstone and further with a connecting tube located at the lower end of the rear side of said grindstone shield, and that said vertical threaded hole of said grindstone shield receives therein a threaded locating element of a hollow construction containing a locating ball and a biasing means for urging said locating ball to emerge partially beyond an upper end of said locating element, said locating element having a nut threaded on a lower end thereof, and further that said angle adjusting plate of said worktable is provided with a plurality of concave retaining surfaces located at the outer edge thereof in a manner that said concave retaining surfaces correspond in location to a plurality of predetermined angles, with each of said concave retaining surfaces so dimensioned as to receive therein said locating ball of said locating element.

* * * * *